US009835397B2

(12) United States Patent
Stussak

(10) Patent No.: US 9,835,397 B2
(45) Date of Patent: Dec. 5, 2017

(54) FIREARM EJECTORS AND RECEIVERS AND FIREARMS INCLUDING SUCH FIREARM EJECTORS

(71) Applicant: HECKLER & KOCH GmbH, Oberndorf (DE)

(72) Inventor: Martin Stussak, Schömberg (DE)

(73) Assignee: HECKLER & KOCH GmbH, Oberndorf (DE)

( * ) Notice: Subject to any disclaimer, the term of this patent is extended or adjusted under 35 U.S.C. 154(b) by 0 days.

(21) Appl. No.: 14/836,940

(22) Filed: Aug. 26, 2015

(65) Prior Publication Data

US 2015/0369553 A1 Dec. 24, 2015

Related U.S. Application Data

(63) Continuation of application No. PCT/EP2014/000442, filed on Feb. 18, 2014.

(30) Foreign Application Priority Data

Feb. 27, 2013 (DE) ..... 10 2013 003 435

(51) Int. Cl.
*F41A 15/00* (2006.01)
*F41A 15/12* (2006.01)
*F41A 15/16* (2006.01)

(52) U.S. Cl.
CPC ..... *F41A 15/12* (2013.01); *F41A 15/16* (2013.01)

(58) Field of Classification Search
CPC ..... F41A 15/12; F41A 15/16
See application file for complete search history.

(56) References Cited

U.S. PATENT DOCUMENTS

| | | | |
|---|---|---|---|
| 1,494,186 | A | 5/1924 | Pomeroy |
| 1,682,704 | A | 8/1928 | Loomis |
| 1,796,757 | A | 3/1931 | Little |

(Continued)

FOREIGN PATENT DOCUMENTS

| | | |
|---|---|---|
| DE | 709083 | 8/1941 |
| DE | 727308 | 4/1943 |

(Continued)

OTHER PUBLICATIONS

Intellectual Property Office of Singapore, "Search Report," issued in connection with Singaporean Application No. 11201506599U, dated Aug. 8, 2016, 10 pages.

(Continued)

*Primary Examiner* — Gabriel Klein
(74) *Attorney, Agent, or Firm* — Hanley, Flight & Zimmerman, LLC

(57) ABSTRACT

Firearm ejectors and receivers and firearms including such firearm ejectors are disclosed. An example ejector for a firearm includes a body including a projection extending therefrom, the ejector to be movably coupled to a receiver of the firearm to enable the projection including an engagement surface to be disposed in a movement path of a breechblock, the engagement surface to be engaged by a cartridge casing during a recoil process to enable the cartridge casing to be ejected from the firearm; and a spring to bias the body relative to the receiver, the body to be movably relative to a longitudinal axis of the receiver upon impact with the cartridge.

20 Claims, 9 Drawing Sheets

(56) References Cited

U.S. PATENT DOCUMENTS

| | | | | |
|---|---|---|---|---|
| 2,411,979 | A * | 12/1946 | Rataiczak | F41A 15/16 42/25 |
| 2,436,937 | A | 3/1948 | Rataiczak | |
| 3,431,669 | A | 3/1969 | Morrow | |
| 3,967,404 | A | 7/1976 | Reynolds | |
| 4,269,108 | A | 5/1981 | Stoner | |
| 5,608,981 | A * | 3/1997 | Canaday | F41A 15/16 42/25 |
| 2006/0090387 | A1 | 5/2006 | Zeh | |
| 2011/0168009 | A1 | 7/2011 | Robb et al. | |
| 2012/0180646 | A1 | 7/2012 | Wössner et al. | |

FOREIGN PATENT DOCUMENTS

| | | |
|---|---|---|
| DE | 925698 | 3/1955 |
| DE | 1015724 | 9/1957 |
| DE | 102010009488 | 4/2011 |
| DE | 102010009427 | 3/2012 |
| FR | 887017 | 11/1943 |
| GB | 746227 | 3/1956 |
| LU | 28994 | 4/1948 |

OTHER PUBLICATIONS

Japanese Patent Office, "Notice of the Reason for Refusal," issued in connection with Japanese Patent Application No. 2015-559438, dated Jul. 26, 2016.

International Searching Authority, "International Search Report", issued in connection with PCT Application No. PCT/EP2014/000442, dated Apr. 30, 2014, 5 pages.

International Searching Authority, "Written Opinion", issued in connection with PCT Application No. PCT/EP2014/000442, dated Apr. 30, 2014, 8 pages.

German Patent and Trademark Office, "Office Action", issued in connection with German Patent Application No. 10 2013 003 435.3, dated Sep. 5, 2013, 16 pages.

Patent Cooperation Treaty, "International Preliminary Report on Patentability," issued in connection with PCT Application No. PCT/EP2014/000442, dated Sep. 11, 2015, 7 pages.

* cited by examiner

FIREARM EJECTORS AND RECEIVERS AND FIREARMS INCLUDING SUCH FIREARM EJECTORS

RELATED APPLICATION

This patent is a continuation of International Patent Application Serial No. PCT/EP2014/000442, filed Feb. 18, 2014, which claims priority to German Patent Application 10 2013 003 435.3, filed Feb. 27, 2013, both of which are hereby incorporated herein by reference in their entireties.

FIELD OF THE DISCLOSURE

This patent relates generally to firearm ejectors and, more specifically, to firearm ejectors and receivers and firearms including such firearm ejectors.

BACKGROUND

Firearm ejectors may be used to eject and/or discard a cartridge casing from a firearm after the cartridge casing has been fired. When using a firearm, the process of shooting and subsequently ejecting an empty cartridge casing may include a bolt and/or a bolt head guiding a cartridge from a cartridge supply (e.g., a magazine) into a cartridge chamber. After the cartridge is positioned and/or secured in the cartridge chamber, a firing pin may be released by actuating a trigger (e.g., a trigger mechanism). After being released, the firing pin strikes a base of the cartridge and a projectile (e.g., a bullet) projects out of the cartridge chamber and through a barrel of the firearm. In some examples, a force(s) and/or gas(es) that is released from the ignition of the charge is used to cycle and/or displace the bolt and/or breech block. In piston operated firearms, gases from the cartridge ignition act against a piston and drive a bolt rearward toward a stock and/or rear of the firearm. As the breech moves toward the rear of the firearm, a cartridge extractor on the bolt and/or bolt head extracts the cartridge casing from the cartridge chamber and an ejector causes the cartridge casing to be ejected from the firearm.

DETAILED DESCRIPTION

Figure 1:
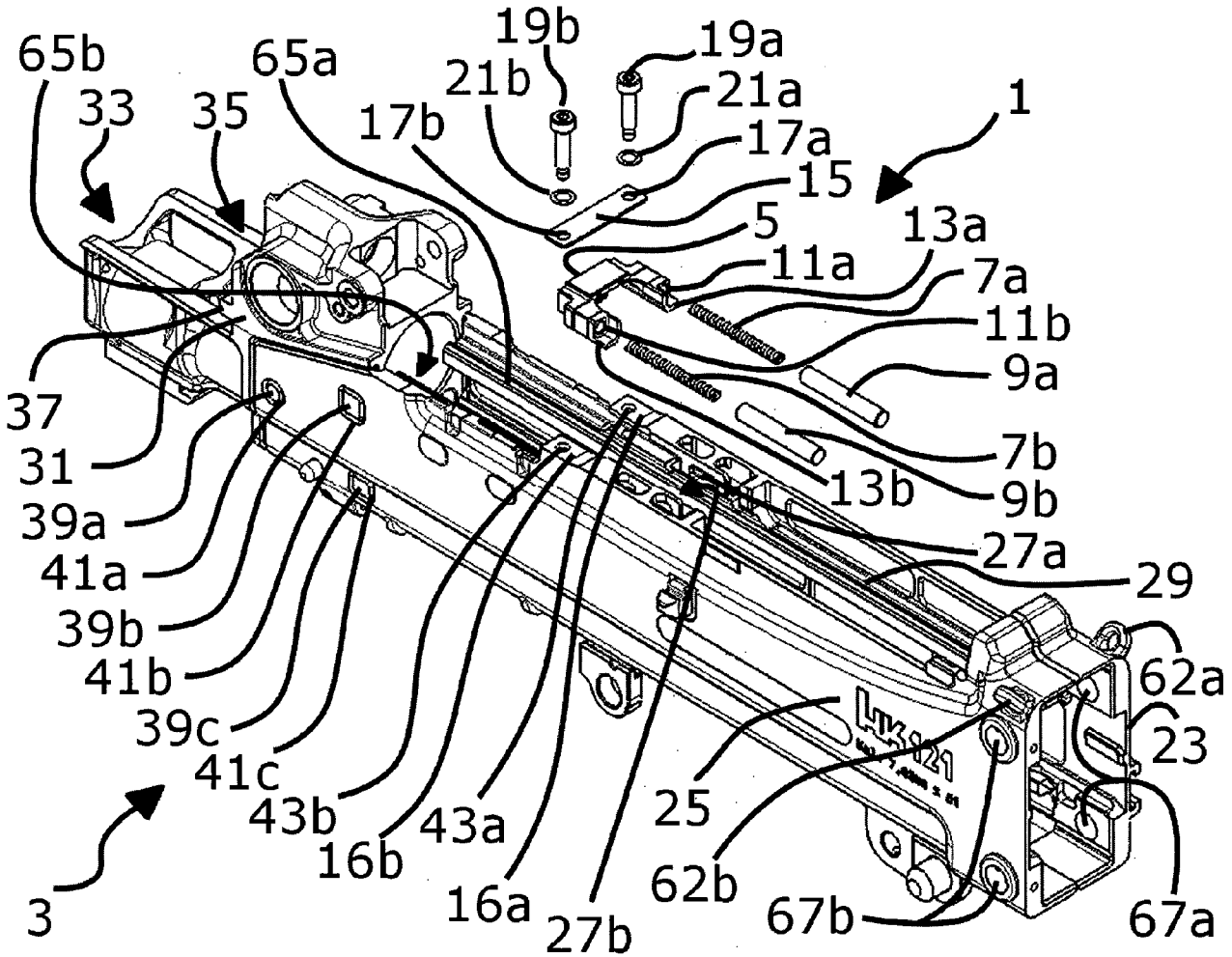
FIG. 1 shows an exploded rear view an example receiver and an example ejector in accordance with the examples disclosed herein.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples disclosed herein relate to example firearm ejectors that are and/or are to be movably and/or biasably coupled to and/or within an example receiver of an example firearm. In some examples, the example ejectors are movable along and/or relative to a longitudinal axis of the receiver and/or the firearm. In some examples, when firing an example firearm including the example ejectors, some example ejectors include springs to absorb some of the impact forces imparted by a cartridge casing during a cartridge ejection process. In some examples, the springs are positioned within respective sleeves to reduce the likelihood that the springs become damaged and/or unseated from the ejector when firing the firearm. In some examples, the springs and/or the respective sleeves are positioned within channels and/or grooves defined by the receiver.

In some examples, in a resting position of the ejector, the springs bias the example ejector forward into engagement with one or more stops. In some examples, the stops are fasteners that couple a plate to the receiver. In some such examples, to guide the movement of the ejector, the fasteners engage and/or interact with surfaces (e.g., lateral surfaces) of the ejector as the ejector moves between a forward, resting position and a rearward, impacted position. In some examples, the plate forms a portion (e.g., a top portion) of a channel in which the example ejector is disposed and/or couples opposing shells of the receiver together.

In some examples, in an impacted position of the ejector, the cartridge casing engages the ejector and urges the ejector rearward against the biasing force of the springs. In some examples, the ejector includes a recess and/or notch against which a base of the cartridge casing engages. The notch may include surfaces that intersect at approximately a right angle or at any other suitable angle. However, the notch and/or the ejector may have any suitable profile to facilitate the ejection of cartridges from the firearm.

In some examples, as the cartridge casing is moved rearward, the cartridge casing has energy that is transferred to or at least a portion of which is transferred to the example ejector upon impact. Using the examples disclosed herein, the ejector is biased by a spring to enable at least a portion and/or some of the energy transferred to and/or absorbed by the spring instead of being fully imparted on a rigid and/or fixed ejector as with some other examples. Thus, the examples disclosed herein may have a longer useful life based on less impact forces being directly absorbed by the receiver and/or the ejector and instead these forces are at least partially absorbed by the one or more springs that bias the ejector.

When the biasing force of the springs is greater than the force imparted by the cartridge casing, in some examples, the springs urge the ejector forward to eject the cartridge casing from the firearm. In some examples, when ejecting the cartridge casing from the firearm, the example ejector rotates the cartridge casing counterclockwise out of an extractor of a bolt and through an ejection window defined by the receiver.

The examples disclosed herein relate to example firearm ejectors including an example body having a projection and/or ejector element. In some examples, after the example firearm ejector is coupled to and/or mounted on an example receiver of an example firearm, the projection extends into a movement path of a bolt. In some examples, the movement path extends forward toward a muzzle and/or forward end of the firearm and rearward toward a stock and/or rear end of the firearm. The example projection of the ejector forms an engaging surface and/or counter bearing surface that is engaged by a cartridge casing as the cartridge casing is extracted rearward by an extractor. The examples disclosed herein also relate to example receivers including an example ejector and example firearms including an example ejector. Some example firearms on which the example ejectors may be implemented include, for example, rifles, long guns, short guns, pistols, assault rifles, submachine guns, machine guns, general purpose machine guns, etc.

Some example ejectors are used on firearms such as the HK121 by the applicant and assignee of the present patent. An example description of such an example ejector is described in DE 10 2010 009 488 B3, which is hereby incorporated herein by reference in its entirety. As described in DE 10 2010 009 488 B3, the breechblock includes a longitudinal groove on an upper surface from which a projection and/or ejector tappet of a stationary ejector extends when the breechblock returns after firing a cartridge. In some examples, after the cartridge is fired, the cartridge casing is withdrawn from a cartridge casing and moved by an extractor toward the ejector tappet. In this example, the engagement between the cartridge casing and the ejector tappet rotates and ejects the cartridge casing from the firearm. In this example, the engagement between the cartridge casing and the ejector tappet imparts a relatively heavy load on the extractor. As the cartridge casing rotates out of the receiver, the cartridge casing engages and deflects downward, through a cartridge ejector opening and/or window of the receiver. In some examples, the heavy loads imparted on the example ejector and/or the example extractor induces wear and a reduced service life of the ejector and/or other components.

Some example ejectors include a thrust bolt spring mounted on a bolt head. In some examples, the thrust bolt is pretensioned by a spring against a base of a cartridge casing. After a round is fired, an extractor extracts the cartridge casing from the cartridge chamber as the bolt retracts and the spring urges the thrust bolt outward to engage the cartridge casing to eject the cartridge casing from the firearm. Some firearms that use such an example thrust bolt include firearms of the applicant and assignee of the present patent such as, for example, G36, HK416, HK417. U.S. Patent Publication Serial No. 2011/0168009 describes a firearm including a thrust bolt. U.S. Patent Publication Serial No. 2011/0168009 is hereby incorporated herein by reference in its entirety.

The spring force of the spring used in connection with some of these thrust bolts is relatively low to enable recoil springs of the bolt to return the bolt during the recoil process. In some examples such as firearms including rotating bolts, there is a relatively small amount of space to position a thrust bolt spring having a higher spring force. DE 10 2010 009 427 B4 by the applicant and assignee of the present patent describe a firearm including a rotating bolt. DE 10 2010 009 427 B4 is incorporated herein by reference in its entirety.

In some examples, thrust bolts may not be suitable for firearms having a higher cadence and/or longer firing sequences because the time period allotted for the ejection process is short and the spring of the thrust bolt may not be able to move the thrust bolt quickly enough to eject and/or move the fired cartridge casing from the firearm. In some examples, higher cadences and longer firing sequences of sustained firing may cause cartridges to jam and/or not be ejected from firearms including a thrust bolt.

Some example semiautomatic rifles include the HK-SL6 and the HK-SL7 by the applicant and assignee of present patent. Some of these example semiautomatic rifles include a rolling block and an ejector including a two-armed rocker lever. In some examples, the two-armed rocker lever is disposed on the side of the receiver and extends in a longitudinal direction of the semiautomatic rifle. To extract a cartridge casing that has been fired from a firearm including a two-armed rocker lever, an extractor on a bolt head removes the cartridge casing from the cartridge chamber and travels toward the two-armed rocker lever. In some examples, the arms of the rocker lever include curved ends where a front end is moved upward to engage the bolt head and force a cartridge casing out of the bolt head from below as a back end is moved downward. In some examples, a spring and/or spring assembly is used to displace the rocker lever. In some such examples, the spring force of the spring used by the ejector is relatively low because of the structure of the two arms. In some examples, an ejector including a two-armed rocker lever is prone to wear and may not be suitable for firearms having higher cadences and/or loads sustained during continuous firing.

DE 1 015 724 mentions an example ejector used with automatic firearms. The ejector of DE 1 015 724 mentions a bolt head including a spring mounted ejector slider. As the bolt returns during recoil, the ejector slider engages a spring mounted, pivotable projection and/or mass that drives the ejector slider out of the bolt to strike a base of the cartridge shell and eject the cartridge shell from the firearm. In some examples, the bolt including the ejector slider has a relatively complex structure and a number of components that are prone to wear and breaking. For example, the engagement between the ejector slider and the spring mounted, pivotable projection may deflect and transfer the engagement force and/or kinematic energy to the receiver. In some examples, the deflection of the projection and/or the engagement force received by the receiver may reduce the useful life of the projection and/or the receiver. In some examples, some firearm ejectors may be prone to wear, may be structurally complex and/or may not suited for continuous sustained fire and/or component downtimes.

FIGS. 1-4 illustrate an exploded view of an example ejector 1 and an example receiver 3. In this example, the ejector 1 includes a U-shaped body 5 that receives springs 7*a*, 7*b* that cushion and/or bias the body 5. In some examples, the springs 7*a*, 7*b* are helical springs that are positioned in respective guides and/or sleeves 9*a*, 9*b* that may be supported by and/or positioned adjacent to the receiver 3. In some examples, the guide sleeves 9*a*, 9*b* have a closed end against which the springs 7*a*, 7*b* are supported when the springs 7*a*, 7*b* are disposed in the guide sleeves 9*a*, 9*b*. In some examples, the guide sleeves 9*a*, 9*b* and/or the springs 7*a, b* are sized to substantially prevent the spring 7*a*, 7*b* from jamming and/or otherwise malfunctioning when the springs 7*a*, 7*b* are disposed in the guide sleeves 9*a*, 9*b*. In this example, the body 5 defines recesses, grooves, cavities, spring seats, blind holes and/or accommodations 11*a*, 11*b* that receive ends of the springs 7*a*, 7*b*. In this example, the body 5 defines guiding surfaces, grooves, spring guides and/or channels 13*a*, 13*b* immediately adjacent the blind holes 11*a*, 11*b* that guide the ends of the springs 7*a*, 7*b* within and/or relative to the blind holes 11*a*, 11*b*.

In this example, the receiver includes a first side and/or shell 23, a second side and/or shell 25 and a connecting block 31. In some examples, the first and second shells 23, 25 are separately produced and/or finished and then coupled. In some examples, the first and second shells 23, 25 are coupled and then finished by performing additional processes (e.g., milling) on the first and second shells 23, 25.

In this example, the connecting block 31 forms a front portion of the receiver 3 and includes a longitudinal axis that is substantially coaxial to a longitudinal axis of the receiver 3. In some examples, the connecting block 31 defines an aperture and/or a barrel receiver 33 to accommodate and/or receive a barrel and/or an aperture and/or a gas piston rod receiver 35 to accommodate and/or receive a gas piston rod, for example. In this example, when firing the firearm, a gas piston rod actuates to cycle the firearm to discharge the fired cartridge shell and reload the firearm, for example.

Figure 3:
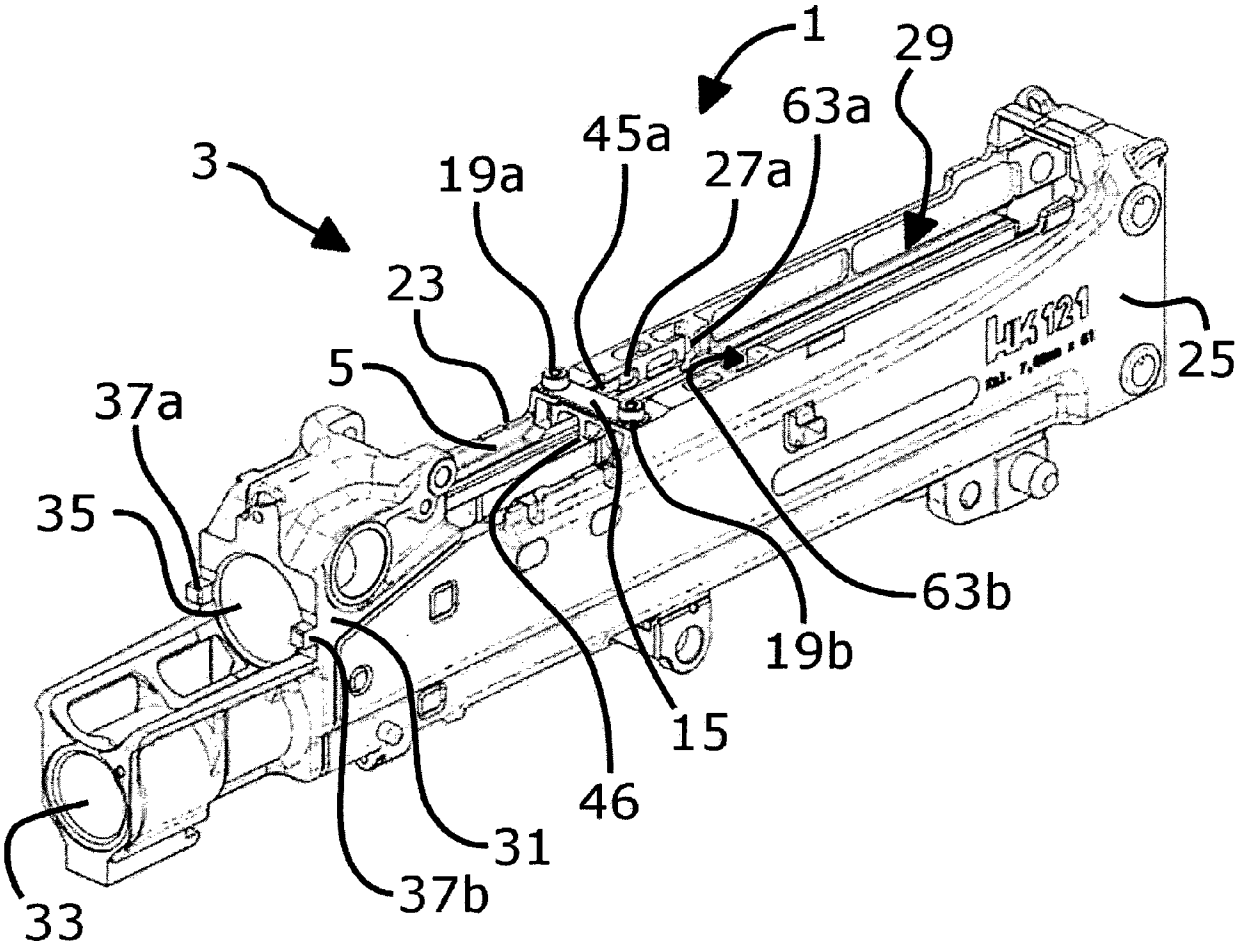
FIG. 3 shows a front perspective view of the example receiver of FIG. 1 including the example ejector.

As shown in the example of FIG. 3, the connecting block 31 includes projections and/or guide tappets 37*a*, 37*b* on the barrel receiver 33 for aligning the barrel. As shown in the example of FIG. 1, to couple the connecting block 31 to the first and second shells, 23, 25, the connecting block 31 includes connecting pins and/or projections 39*a*, 39*b*, 39*c* that are received by recesses and/or apertures 41*a*, 41*b*, 41*c* of the first and/or second shells 23, 25.

In this example, a guide channel and/or a space 29 is defined between the first and second shells 23, 25 to enable a breechblock and/or a bolt to longitudinally travel and/or move within and/or relative to the first and/or second shells 23, 25. In some examples and as shown in the example of FIG. 1, the first and second shells 23, 25 define and/or include opposing guide rails 65*a*, 65*b* that guide the movement of the breechblock and/or the bolt within the receiver 4. In some examples, the guide rails 65*a*, 65*b* are grooves, depressions, ridges, etc. In some examples, the breechblock may include a roller guide and/or other guide(s) to guide the movement of the breechblock relative to the firearm.

In some examples, the receiver 3 includes a trigger assembly that extends into the guide channel 29. In some examples, the receiver 3 includes a cartridge ejection window on an undersurface of the first and/or second shells 23, 25. In some examples, a cover and/or supply cover is disposed on and/or coupled to the receiver 3.

As shown in the example of FIG. 1, to enable a carrying strap to be coupled to the firearm and/or the receiver 3, the first and second shells 23, 25 define apertures and/or eyelets 62*a*, 62*b*. In some examples, to enable a shoulder rest and/or stock to be coupled to the firearm and/or the receiver 3, the first and second shells 23, 25 define recesses and/or apertures 67*a*, 67*b*. In some examples, a stock and/or shoulder rest is coupled to and/or accommodated by the first and second shells 23, 25.

Figure 4:
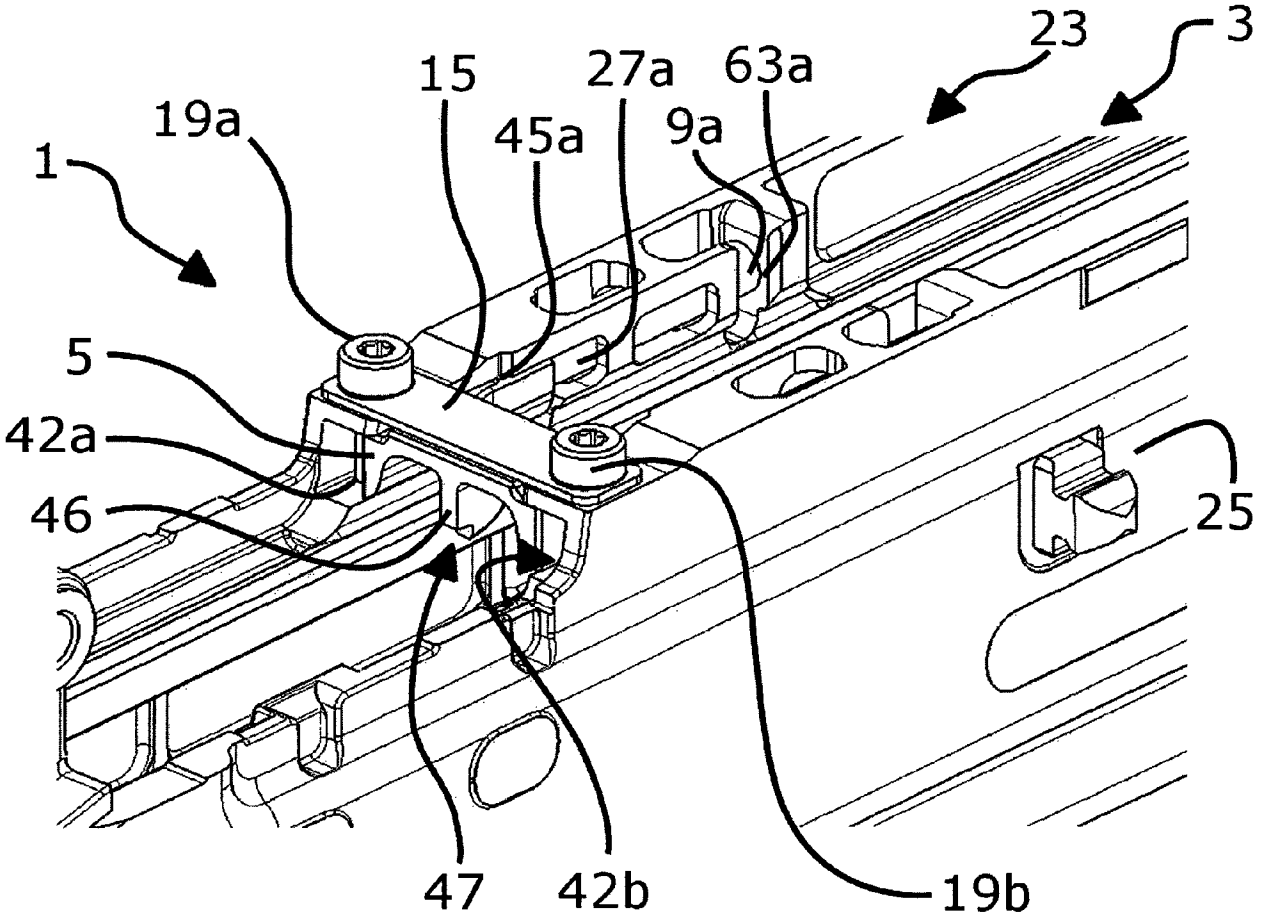
FIG. 4 shows an enlarged perspective front view of a portion of the example receiver and the example ejector of FIG. 3.

In some examples, the ejector 1 is coupled (e.g., movably coupled) to the receiver 3. As shown in FIG. 4, to enable the ejector 1 to be coupled (e.g., movably coupled) to and/or within the receiver 3, the receiver 3 defines example recesses, channels and/or grooves 27*a*, 27*b* that are configured to receive and/or enable the ejector 1 to longitudinally move relative to and/or within the receiver 3, for example. In some examples, the grooves 27*a*, 27*b* have an open end to enable the ejector 1 to be positioned within the grooves 27*a*, 27*b* and/or within the receiver 3, for example. In some examples, the recesses 27*a*, 27*b* are formed when processing and/or producing the first and/or second shells 23, 25. In some examples, the recesses 27*a*, 27*b* are formed during subsequent processes on the first and/or second shells 23, 25. Some of the subsequent processes may include milling, drilling, etc.

In the example shown in FIGS. 3 and 4, recesses, grooves, channels and/or apertures 63*a*, 63*b* are defined to receive and/or accommodate the guide sleeves 9*a*, 9*b*. In some examples, the recesses 27*a*, 27*b* that receive the ejector 1 and the recesses 63*a*, 63*b* that receive the springs 7*a*, 7*b* and/or the guide sleeves 9*a*, 9*b* interact to enable the springs 7*a*, 7*b* to bias the ejector 1. In some examples, the recesses 63*a*, 27*a* are substantially flush with an interior surface of the first shell 23 and the recesses 63*b*, 27*b* are substantially flush with an interior surface of the second shell 25. In some examples, the recesses 63, 63*b* are bores and/or apertures that are designed to be complementary to and/or accommodate the guide sleeves 9*a*, 9*b*. In some examples, portions and/or ribs of the first and/or second shells 23, 25 that define the recesses 27*a*, 27*b*, 63*a*, 63*b* substantially prevent the guide sleeves 9*a*, 9*b* and/or the springs 7*a*, 7*b* from being inadvertently removed from the receiver 3. In some examples, the recesses 63*a*, 63*b* enable the guide sleeves 9*a*, 9*b* to be disposed within the first and/or second shells 23, 25 and/or to be disposed within the recesses 27*a*, 27*b*.

Figure 2:
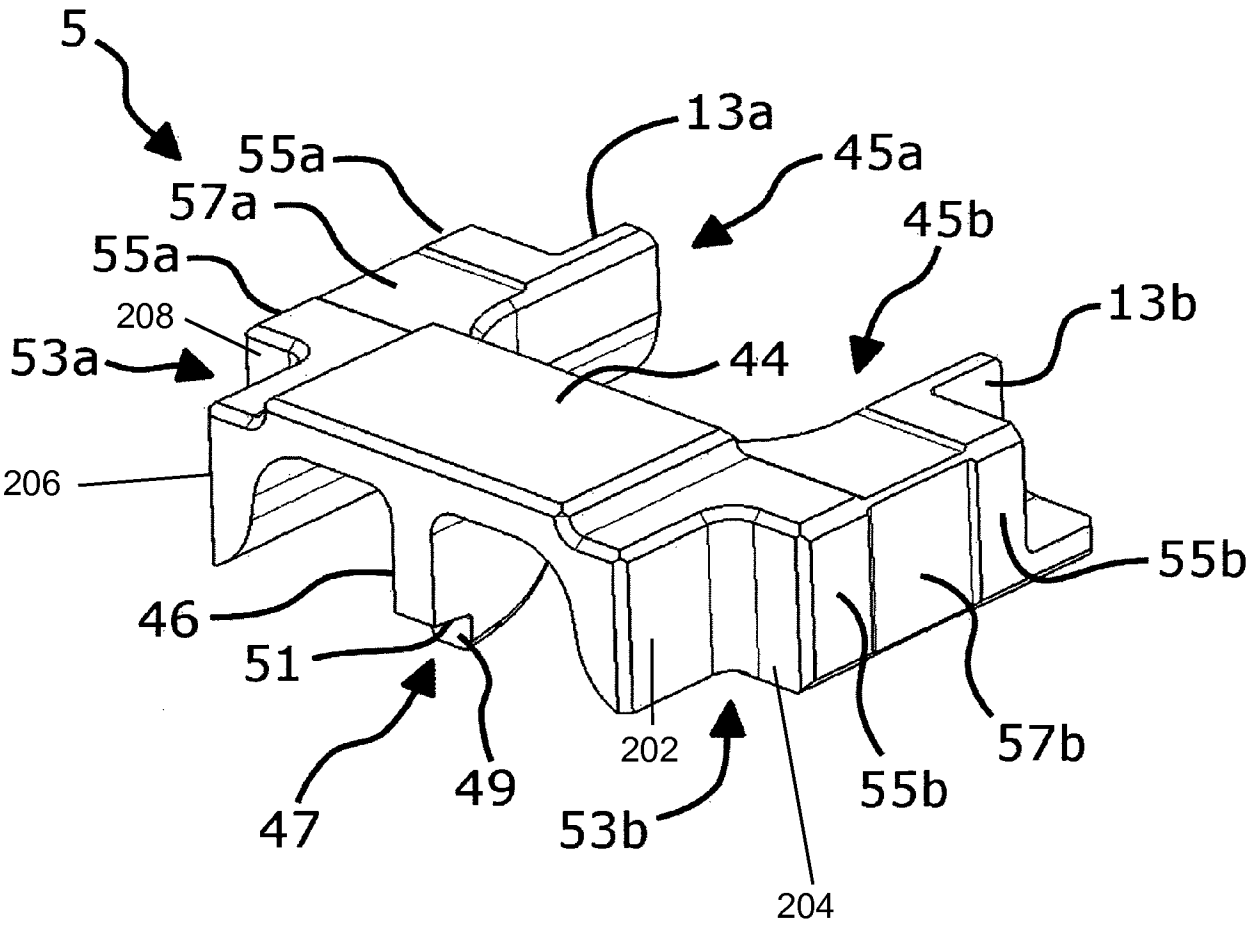
FIG. 2 shows an example front perspective view of the example ejector of FIG. 1.

In some examples, to couple the ejector 1 to the receiver 3, fasteners 19*a*, 19*b* extend through a plate and/or stabilizing element 15 and are received within bores and/or apertures 42*a*, 42*b* of the receiver 3. In this example, the apertures 42*a*, 42*b* include threads. The fasteners 19*a*, 19*b* may be screws, bolts, etc. As shown in the example of FIGS. 1 and 3, the ejector 1 is disposed adjacent the plate 15 and surfaces, engaging surfaces and/or shoulders 16*a*, 16*b* of the receiver 3. To enable the plate 15 to be coupled to the receiver 3, the plate 15 defines apertures 17*a*, 17*b* through which the fasteners 19*a*, 19*b* are to extend. In some examples, washers 21*a*, 21*b* surround the fasteners 19*a*, 19*b* to, for example, distribute a load imparted by the fasteners 19*a*, 19*b* on the plate 15 and/or to substantially prevent ends of the fasteners 19*a*, 19*b* from passing through the apertures 17*a*, 17*b*. In some examples and as shown in the example of FIG. 2, to enable the ejector 1 to be guided relative to the receiver 3 when transitioning between a forward and/or resting position and a rearward and/or impacted position, the ejector 1 defines notches, steps and/or guide surfaces 53*a*, 53*b*. In some examples, when the fasteners 19*a*, 19*b* couple the plate 15 and the ejector 1 to the receiver 3, the fasteners 19*a*, 19*b* extend through the notches 53*a*, 53*b* and, in a resting position, the springs 7*a*, 7*b* urge and/or bias the ejector 1 into engagement with the fasteners 19*a*, 19*b*. Thus, in some examples, the movement of the ejector 1 is relatively restricted based on the interaction between the fasteners 19*a*, 19*b*, the springs 7*a*, 7*b*, the plate 15 and/or the first and/or second shells 23, 25.

As shown in the example of FIG. 2, the body 5 has a U-shaped profile including a first portion and/or lateral leg 45*a*, a second portion and/or connecting element 44 and a third portion and/or lateral leg 45*b* where the second portion 44 is positioned between and couples the first portion 45*a* and the third portion 45*b*. In this example, the first and third portions 45*a*, 45*b* are mirror images of one another and/or are reflected across a longitudinal axis of the ejector 1. In this example, the first and third portions 45*a*, 45*b* extend toward a rear and/or stock of the firearm when the ejector 1 is coupled to the firearm and/or to the receiver 3. In this example, the second portion 44 includes a projection, ejector element and/or tappet 46 that extends from the second portion 44. In some examples, when the ejector 1 is coupled to the receiver 3, the projection 46 extends into the guide channel 29 of the receiver 3 to enable the projection to be engaged by a cartridge casing 59 to eject the cartridge casing from the firearm.

In some examples, the projection 46 defines a notch, a recess and/or a step 47 at an end of the projection 46. In this example, the step 47 includes a substantially right angle and/or forms a substantially cuboid recess. As set forth herein, a substantially right angle means within about five degrees of a right angle and/or accounts for manufacturing tolerances. In some examples, the step 47 includes a first and/or vertical impact and guide surface 49 and a second and/or horizontal impact and guide surface 51. During the recoil process, the guide surfaces 49 and/or 51 are engaged by a cartridge casing. In other examples, the first impact and guide surface 49 and the second impact and guide surface 51 are disposed at any suitable angle relative to one another. For example, the second impact and guide surface 51 may be slanted downward toward the back of the firearm and/or the step 47 has a profile that is substantially complimentary to a cartridge casing.

In some examples and as shown in FIGS. 5-8, as the cartridge casing 59 is being extracted from a cartridge chamber using an extractor 69, the cartridge casing 59 may engage the first impact and guide surface 49 and/or the second impact and guide surface 51 depending on, for example, the movement of the bolt 71. In some examples, to move and/or guide the cartridge casing 59 into a repeatable ejection position, the first and second impact and guide surfaces 49, 51 are disposed to cause engagement with an end and/or base 61 of the cartridge casing 59 during the recoil process. In some examples, during the ejection process, the base 61 rests relatively snuggly in a corner of the step 47 and/or against the first and/or second impact and guide surfaces 49, 51

In contrast to some ejectors, such as the ejector described in DE 10 2010 009 488, the example ejector 1 includes the guide surfaces 53*a*, 53*b*. DE 10 2010 009 488 is hereby incorporated herein by reference in its entirety. In some examples, the guide surfaces 53*a*, 53*b* have an L-shaped cross-section to enable the fasteners 19*a*, 19*b* to engage and/or contact one or more surfaces 202, 204, 206, 208 of the guide surfaces 53*a*, 53*b* and/or to control and/or guide the movement of the ejector 1 as the ejector 1 moves between the forward position and the rearward position. In the forward position, the springs 7*a*, 7*b* urge the ejector 1 into engagement with the fasteners 19*a*, 19*b*. In some examples, at least portions of the surfaces 202, 204 are substantially perpendicular relative to one another and at least portions of the surface 206, 208 are substantially perpendicular relative to one another. As set forth herein, substantially perpendicular means between about five degrees from perpendicular and/or accounts for manufacturing tolerances.

As shown in the example of FIG. 2, the first and third portions 45*a*, 45*b* include recesses and/or flat recesses 57*a*, 57*b* disposed between guide surfaces 55*a*, 55*b* on one or more sides of the first and/or third portions 45*a*, 45*b*. As shown by FIGS. 2 and 4, the guide surfaces 55*a*, 55*b* engage and/or interact with interior surfaces of the first and second shells 23, 25 that define the apertures 27*a*, 27*b*, for example. In some examples, to enable the movement of and/or maneuverability of the ejector 1 within the receiver 3, the recesses 57*a*, 57*b* encourage debris, sand, dirt, etc. to move into the recesses 57*a*, 57*b*. For example, the recesses 57*a*, 57*b* enable the ejector 1 to be relatively self-cleaning and/or substantially prevent the ejector 1 from malfunctioning.

In some examples and as shown in the example of FIG. 1, the first and third portions 45*a*, 45*b* define the spring guides, guide surfaces, L-shaped guide surfaces 13*a*, 13*b* and/or the apertures and/or spring seats 11*a*, 11*b*. In some examples, the spring guides 13*a*, 13*b* guide and/or enable the springs 7*a*, 7*b* to be positioned and/or retained in the apertures 11*a*, 11*b*. In some examples, the spring guides 13*a*, 13*b* substantially restrict the movement of the springs 7*a*, 7*b* to be within for example, the apertures 27*a*, 27*b* if, for example, a malfunction occurs. Some malfunctions may include, for example, a force being imparted on the springs 7*a*, 7*b* that attempts to cause the springs 7*a*, 7*b* to kink and/or unseat from the ejector 1.

The examples of FIGS. 3 and 4 show the ejector 1 coupled to the receiver 3 where the ejector 1 is disposed within the recesses 27*a*, 27*b* of the first and second shells 23, 25 and the guide sleeves 9*a*, 9*b* are disposed within the first and second bores 63*a*, 63*b*. To secure the ejector 1 within the receiver 3, in this example, the plate 15 is coupled to the receiver 3 using the fasteners 19*a*, 19*b*.

In some examples, the plate 15 couples and/or stabilizes the first and second shells 23, 25 adjacent, for example, the engaging surfaces 16*a*, 16*b*. In some examples, the fasteners 19*a*, 19*b* couple the plate 15 to the receiver 3 and/or center, position and/or secure the plate 15 in the longitudinal and/or transverse directions relative to a longitudinal axis the firearm and/or the receiver 3.

In some examples, the fasteners 19*a*, 19*b* extend into the receiver 3 to enable the body 5 of the ejector 1 to directly engage the fasteners 19*a*, 19*b* with the contact surfaces 53*a*, 53*b*. In some examples, the recesses 63*a*, 63*b* that receive the guide sleeves 9*a*, 9*b* are sized to enable the springs 7*a*, 7*b* to be in tension when installed to enable the springs 7*a*, 7*b* to urge the body 5 against the fasteners 19*a*, 19*b*. In some examples, the springs 7*a*, 7*b* engage the closed ends of the guide sleeves 9*a*, 9*b*. In some examples, the springs 7*a*, 7*b* are placed in tension based on the dimensions between, for example, surfaces defining the bores and/or the recesses 63*a*, 63*b* and the screws 19*a*, 19*b* and/or the lengths and/or sizes of the springs 7*a*, 7*b* and/or the ejector 1.

As shown in the example of FIG. 4, the projection 46 extends from the second portion 44 into the guide channel 29. As shown in the example of FIG. 5, the projection 46 extends into a recess, channel and/or groove 77 of the bolt head and/or breech block 71.

Figure 7:
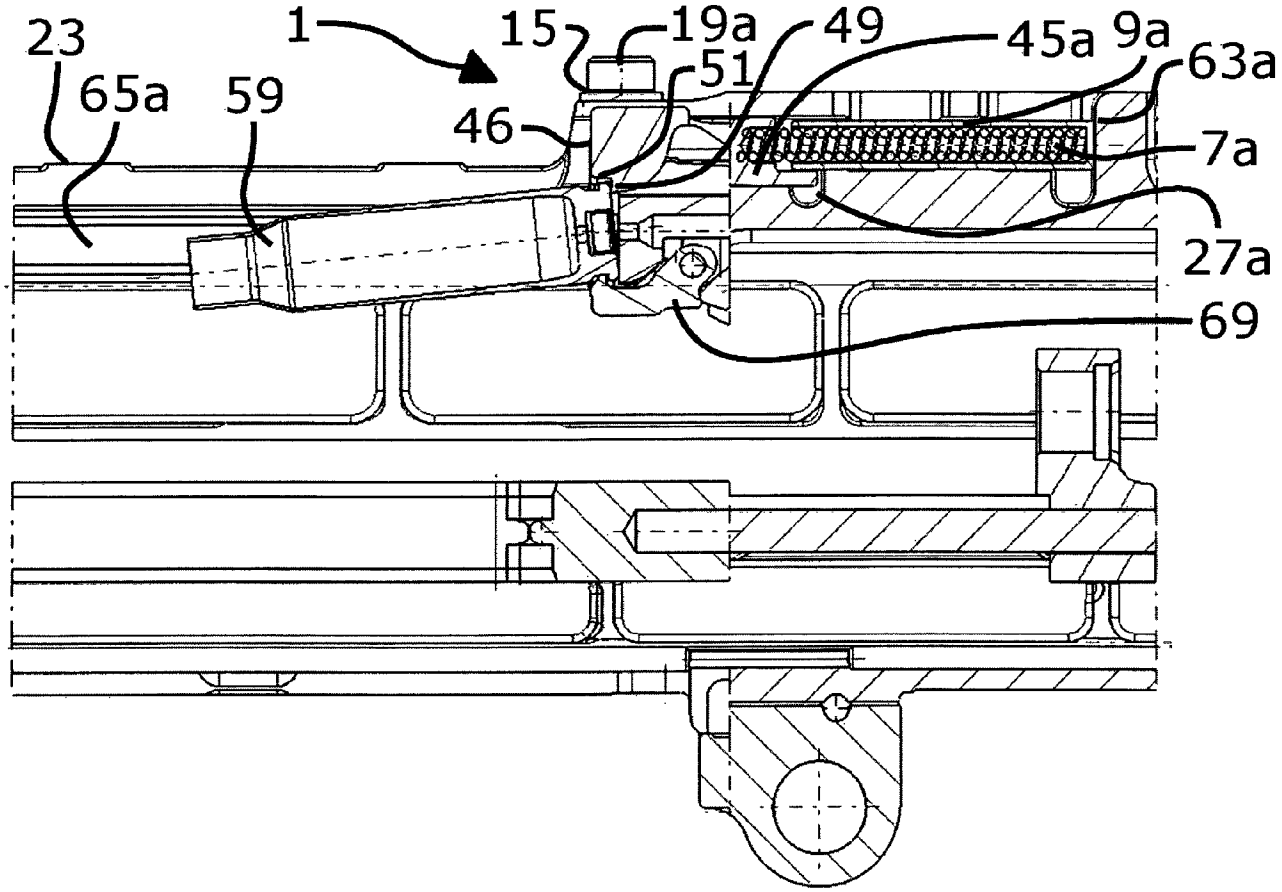
FIG. 7 shows a multi-plane cross-sectional view of the example receiver of FIG. 1 that illustrates the cartridge casing engaging the example ejector and an example spring of the example ejector absorbing at least some energy from the engagement between the cartridge casing and the example ejector.

As shown in the example of FIG. 4, the body 5 is positioned within (e.g., at least partly within) the recess 27*a* defined by the receiver 3 to enable the body 5 to be longitudinally moved back and forth relative to the stock and the muzzle of the firearm. In some examples, the springs 7*a*, 7*b* are positioned within the respective guide sleeves 9*a*, 9*b* which in turn are positioned in the recesses 27*a*, 27*b*. In some examples, to enable the springs 7*a*, 7*b* to be compressed, the springs 7*a*, 7*b* extend from the guide sleeves 9*a*, 9*b* and engage the ejector 1. In some examples, during the recoil process and/or after a cartridge casing 59 engages the ejector 1, the ejector 1 moves and compresses the springs 7*a*, 7*b*. The example of FIG. 7 illustrates the engagement of the cartridge casing 59 and the ejector 1.

FIGS. 5-9 show the process of extracting and/or ejecting the cartridge casing 59 from the firearm and/or from the receiver 3. In some examples, after a cartridge is fired, the breech block is moved rearward by, for example, a gas piston assembly. In some examples, the breechblock includes a bolt carrier and the bolt head 71 on which the extractor 69 is disposed and/or positioned. In some examples, to extract the cartridge casing 59 from the cartridge chamber, the extractor 69 grips the cartridge casing 59 (e.g., a lower portion of the cartridge casing) and moves the cartridge casing 59 rearward when the firearm recoils. In some examples, the projection 46 of the ejector 1 protrudes and/or extends into the groove 77 and into, for example, the longitudinal path of the bolt head 71 to enable the cartridge casing 59 to be received within the recess 47 and/or to impact one or more of the impact and guide surfaces 49, 51.

Figure 5:
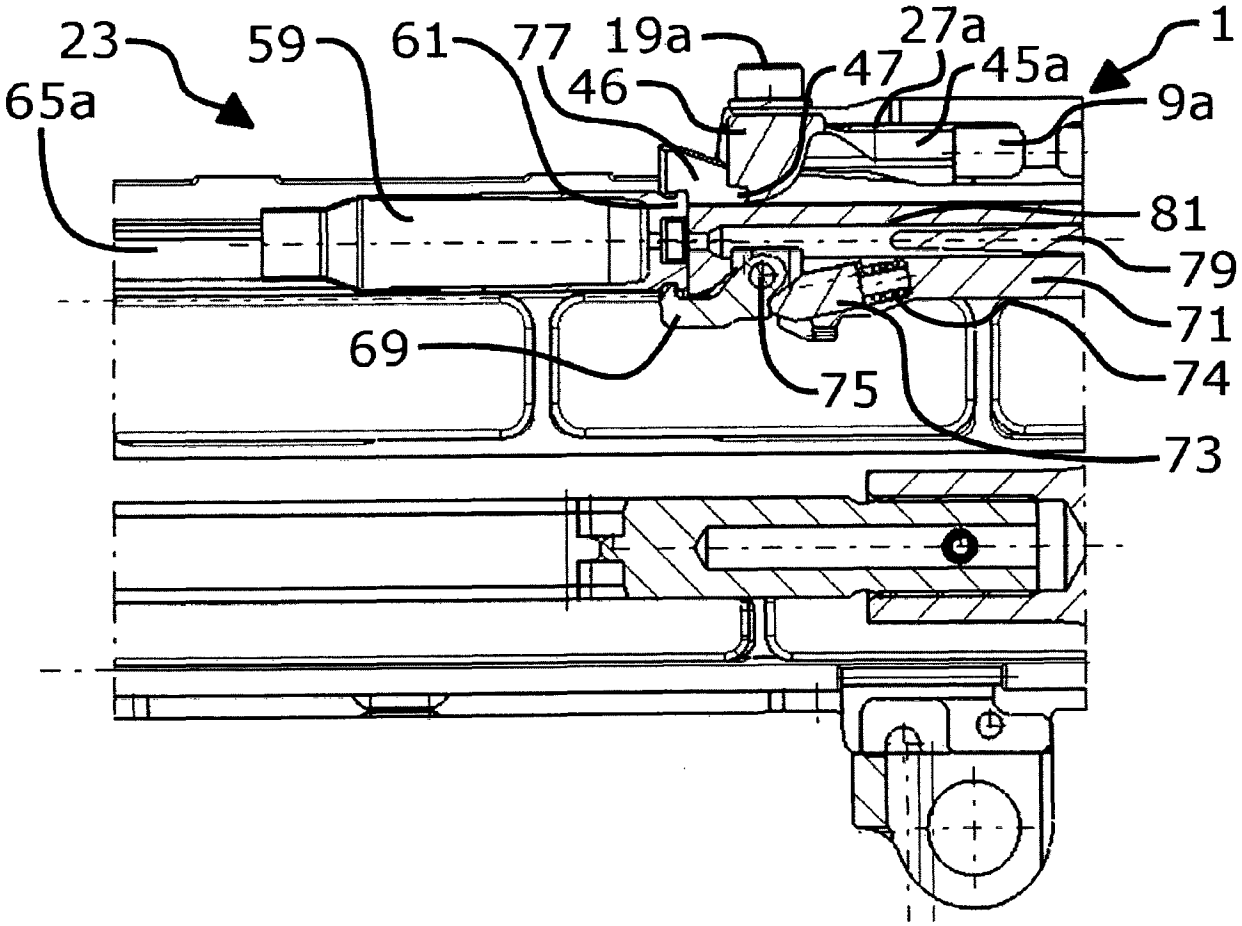
FIG. 5 shows a cross-sectional view of the example receiver of FIG. 1 that illustrates an example extractor extracting a cartridge casing from an example cartridge chamber prior to the cartridge casing engaging the example ejector.

As shown in the example of FIG. 5, the bolt carrier, the bolt head 71 and the cartridge casing 59 move together and/or reward after a round is fired. In this example, the extractor 69 is pivotably coupled to the bolt head 71 about a pivot axis 75. In this example, a bolt and/or lug 73 is used to bias, via a spring 74, the extractor 69 into engagement with the cartridge casing 59. As shown in the example of FIG. 5, a firing pin guide and/or aperture 81 is defined by the bolt head 71 and/or the breechblock. In some examples, a firing pin 79 is longitudinally movable within the firing pin guide 81. In the example of FIG. 5, the cartridge casing 59 is spaced from the projection 46.

Figure 6:
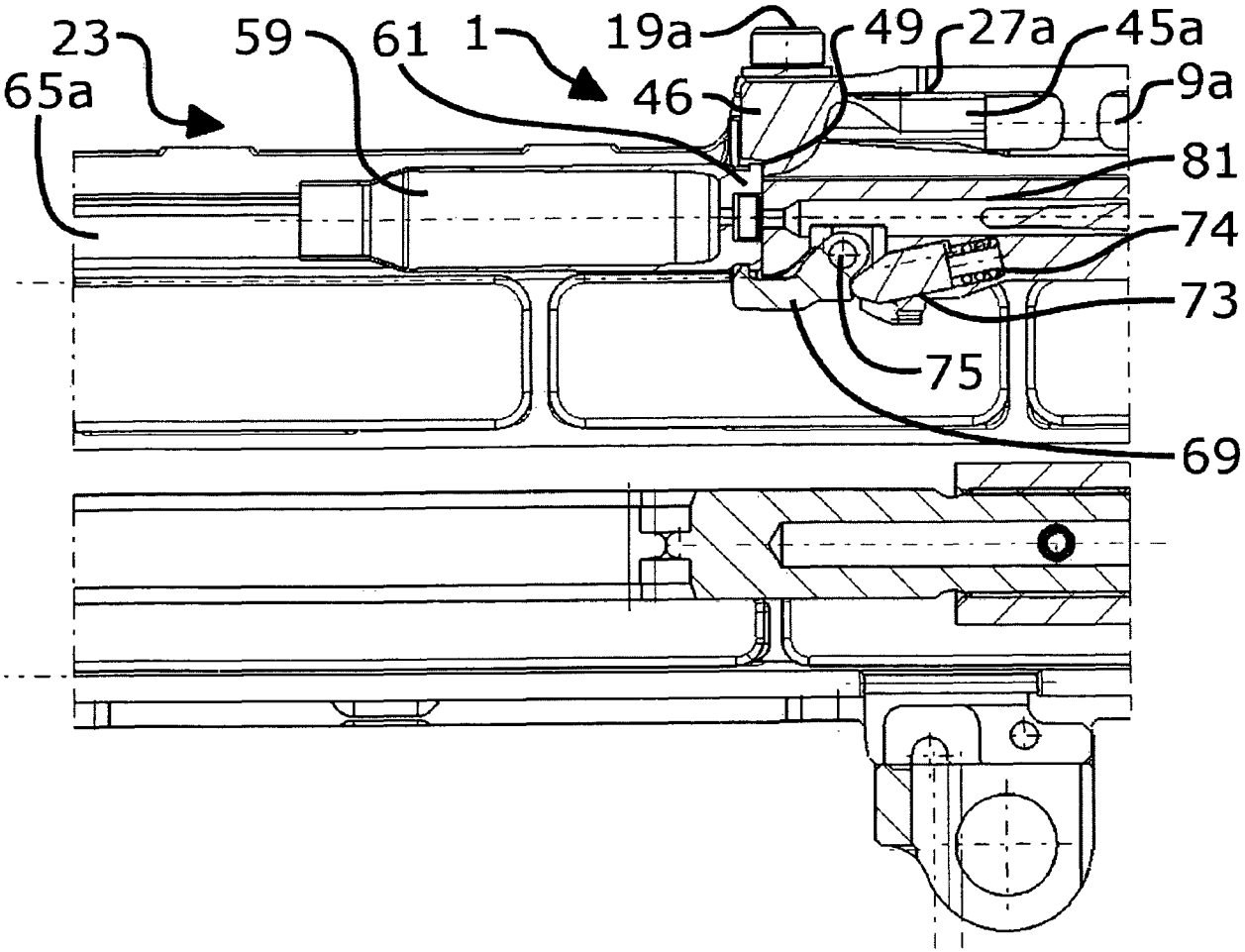
FIG. 6 shows a cross-sectional view of the example receiver of FIG. 1 that illustrates a cartridge casing engaging the example ejector as an example extractor extracts the cartridge casing from the example cartridge chamber.

The example of FIG. 6 shows the base 61 engaging the projection 46 within the recess 47 and/or impacting the impact and guide surface 49. As the bolt head 71 returns during recoil, the bolt head 71 may vibrate and/or move laterally, upward, downward, etc. In some examples, the impact between the cartridge casing 59 and the impact and guide surfaces 49, 51 guide the cartridge casing 59 into, for example, a repeatable impact position, thereby increasing the precision repetition of ejecting the cartridges.

In some examples, when the cartridge casing 59 impacts the ejector 1, the ejector 1 is displaced relative to, for example, a longitudinal axis of the firearm and against the biasing force of the springs 7*a*, 7*b*. In some examples, the interaction between the body 5 and the springs 7*a*, 7*b* reduces an impact force borne by the body 5. In some examples, the interaction between the cartridge casing 59, the body 5 and the springs 7*a*, 7*b* slows, delays and/or retards the ejection of the cartridge casing 59 and/or the speed of the cartridge casing 59 as the cartridge casing 59 is in, for example, a first phase of being ejected from the firearm and/or the receiver 3.

Figure 8:
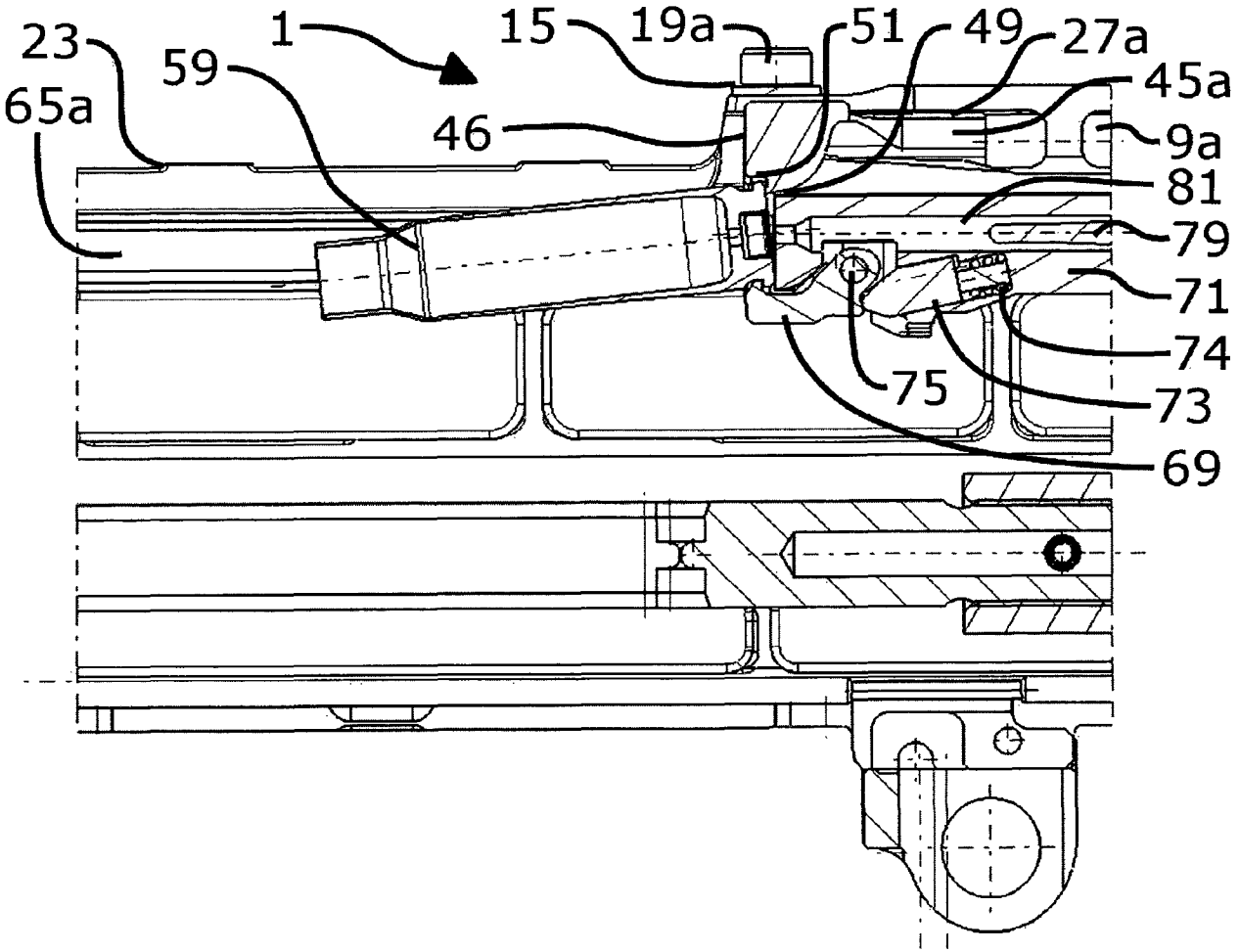
FIG. 8 shows an enlarged cross-sectional view of the example receiver and the example ejector of FIG. 7.

FIGS. 7 and 8 illustrate the cartridge casing 59 being ejected from the receiver 3 and/or the firearm. In comparing FIGS. 6 and 7, in FIG. 7 the ejector 1 is moved rearward and the springs 7*a*, 7*b* are more compressed as the ejector 1 buffers the impact with the cartridge casing 59. As the recoil process continues, the bolt head 71 and the bolt carrier travel rearward and the springs 7*a*, 7*b* substantially prevent an impact and/or a direct impact between the ejector 1 and the receiver 3.

In some examples, the impact between the projection 46 and an upper portion of the base 61 of the cartridge casing 59 rotates the upper portion of the base 61 out of the extractor 69 in, for example, a counterclockwise direction. In some examples, as the cartridge casing 59 is being rotated counterclockwise, the extractor 69 grips a bottom portion of the base 61 and acts as a counter bearing surface, for example.

The example of FIG. 7 illustrates a cross-sectional view of the receiver 3 including the springs 7*a*, 7*b* of the ejector 1. In some examples, an impact between the base 61 and the impact and guide surfaces 49, 51 forces the cartridge casing 59 out of the extractor 69. As shown in the example of FIG. 7, an end of the body 5 is spaced apart from a surface defining the recess 27*a* and/or spaced apart from a front end of the guide sleeve 9*a*.

In some examples, the recesses 27*a*, 27*b* that receive the ejector 1 are larger and/or a wider than the recesses 63*a*, 63*b* that receive the springs 7*a*, 7*b* and/or the guide sleeves 9*a*, 9*b*. In some examples, the recesses 27*a*, 27*b* are sized to guide the longitudinal movement of the ejector 1 between a forward and/or resting position and/or a rearward and/or impacted position. In some examples and as shown in the example of FIG. 4, in the impacted position, the ejector 1 is spaced from the rear surfaces that define the recesses 27*a*, 27*b*. In some examples, the recesses 63*a*, 63*b* are sized to receive and/or house the guide sleeves 9*a*, 9*b*. In some examples, the guide sleeves 9*a*, 9*b* and/or the springs 7*a*, 7*b* are sized to enable the ejector 1 to be spaced from the front ends of the guide sleeves 9*a*, 9*b* when the ejector 1 is in the impacted position. Thus, in such examples, the ejector 1 does not engage the ends of the guide sleeves 9*a*, 9*b* to prevent the rearward movement of the ejector 1. In some examples and as shown in the example of FIG. 7, the guide sleeves 9*a*, 9*b* interact with the spring guides 13*a*, 13*b* to at least partially guide the movement of the ejector 1 and/or to at least partially guide the interaction between the springs 7*a*, 7*b* and the ejector 1. Thus, in such examples, the interaction between the springs 7*a*, 7*b*, the spring guides 13*a*, 13*b* and/or the guide sleeves 9*a*, 9*b* substantially ensures that the springs 7*a*, 7*b* are not unseated from the spring seats 11*a*, 11*b* as the ejector 1 moves reward during an impact and/or recoil.

In some examples, during a second phase of the ejection process, the force imparted against the projection 46 is less than the force provided by the springs 7*a*, 7*b* and the springs 7*a*, 7*b* urge the ejector 1 forward and/or in a direction opposite the direction of the recoiling breech and/or bolt head 71. In some examples, the forward movement of projection 46 further urges and/or encourages the counterclockwise movement of the cartridge casing 59. In some examples and as shown in the example of FIG. 8, the counterclockwise movement of the cartridge casing 59 pivots the extractor 69 about the axis 75 against the biasing force of the spring 74 to enable the cartridge casing 59 to be released and/or ejected from the firearm and/or the receiver 3. In some examples, the cartridge casing 59 is ejected through a cartridge ejection window defined by the first and/or second shells 23, 25.

Figure 9:
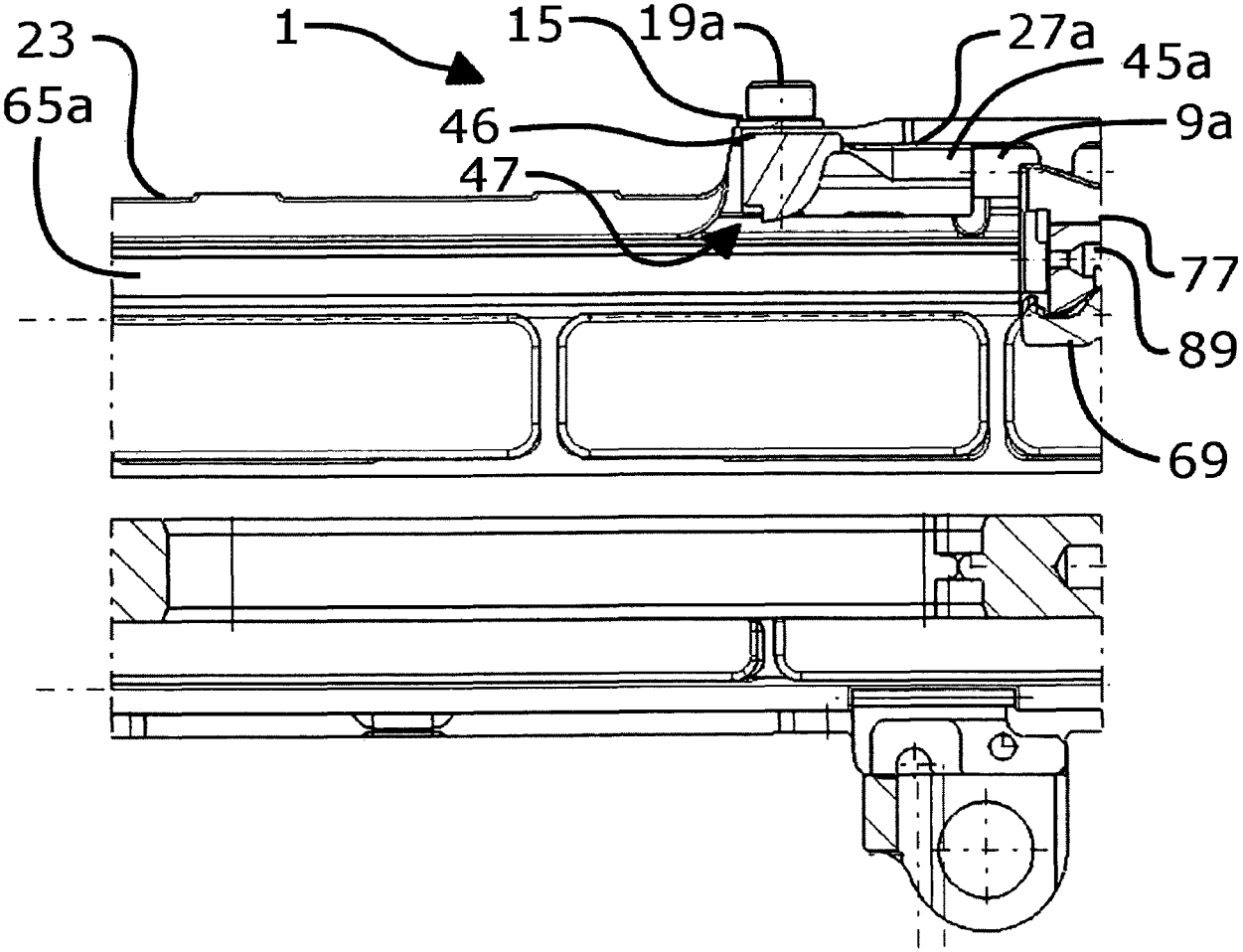
FIG. 9 shows a cross-sectional view of the example receiver of FIG. 1 that illustrates an example extractor after the cartridge casing has been ejected from the firearm.

In the example of FIG. 9, the ejector 1 is in the forward, resting and/or pre-tension position and/or the ejector 1 is further spaced from the ends of the guide sleeves 9*a*, 9*b*. In some examples, the breechblock is positioned in a rearward position and/or tensioned, loaded and/or buffered by bolt springs, a buffer, etc. In some examples, the bolt springs and/or buffer reduces and/or buffers the force of a breechblock and/or the bolt head 71 during the recoil process. In some examples, after the cartridge casing 59 is ejected from the firearm and/or the receiver 3, the spring 74 urges the lug 73 toward the extractor 69 to rotate the extractor 69 clockwise into the resting position, for example. In some examples, when the breechblock moves forward, a new unfired cartridge is guided into the cartridge chamber to repeat the firing process.

In some examples, an ejector is flexibly and/or movably mounted and/or coupled relative to a receiver to enable the ejector to move relative to, for example, a longitudinal axis of the firearm. In some examples, the ejector is deflected rearward upon the impact of the ejector by a cartridge casing during the recoil process of an example firearm. In some examples, the interaction between the ejector and the cartridge casing slows, delays and/or retards the movement of and/or the ejection of the cartridge casing from the firearm and/or receiver until springs begin to again move the ejector forward toward a muzzle of the firearm. In some examples, the surface of the ejector that is impacted by the cartridge base includes a guide(s) and/or a surface(s) that extend into the returning path of the breechblock. In some examples, example firearms include an example ejector. In some examples, example receivers include an example ejector.

In some examples, the example ejectors are relatively fail-safe to increase the reliability of firearms including such example ejectors even if the firearms have high cadences and/or long firing sequences. In some examples, the example ejectors are implemented on automatic firearms and/or machine guns. In some examples, the example ejector can buffer and/or absorb some of the impact forces of the cartridge casings being extracted without compromising and/or impacting reset forces of the recoil spring of the breechblock.

In some examples, the example extractor buffers the impact energy, slows the rotation of the cartridge casing and/or causes a counter reaction of the ejector as the ejector returns from the compressed and/or impacted position. In some examples, having the example ejector spring biased enables less force and/or softer engagement between the cartridge casing and the example ejector in, for example, a first phase of the ejection process when the cartridge casing strikes and/or engages the ejector. In some examples, the engagement with the ejector enables a controlled and/or homogenous rocking and/or pivoting (e.g., counterclockwise rotation) of the cartridge casing. In some examples, as the extractor grips the bottom of the cartridge casing and the cartridge casing engages the ejector, the engagement with the ejector causes the cartridge casing to rotate, for example, counterclockwise. In some examples, as the springs urge the ejector forward, the ejector further urges the cartridge casing to rotate out of the receiver and/or firearm. In some examples, the rotation and/or ejection of the cartridge casing in a relatively consistent and/or defined manner enables the cartridges to be reliably ejected from the firearm even during rapid and/or continuous firing and/or movements of the bolt.

In some examples, the ejector and/or spring biasing the ejector enable a reduced load to be imparted on components (e.g., the ejector, the receiver, etc.) during sustained firing and/or to reduce wear and/or increase the useful life of the examples disclosed herein. In some examples, the example spring loaded ejector can endure and/or have a useful life of over and/or approximately 118,000 shots and/or the extractor can endure and/or have a useful life of over 50,000. In some examples, the failure rate of the example ejectors can be over and/or approximately 50,000 shots.

In some examples, as the breechblock returns during recoil, the breechblock may oscillate within the receiver. In some examples, lateral guides of the bolts cause the breechblock to oscillate during recoil and/or cause the cartridge casing to impact the projection of the ejector at different angles and/or surfaces and/or contact points, for example.

In some examples, the projection of the ejector includes two impact and guides surfaces that guide the movement of the cartridge casing in a defined, precisely repeatable and/or reliable manner relative to a recess of the ejector, for example. In some examples, the cartridge casing impacts a corner of recess of the ejector.

During the ejection process, the impact and guide surfaces of the ejector guide a cartridge casing into a guide and impact recess, for example. In some examples, the guide and impact recess of the projection has a rectangular profile, for example. In some examples, the guide and impact surface compensates for differences and/or irregularities in the movement of the bolt and/the locations and/or points where the cartridge casing impacts the projection of the ejector by enabling the cartridge casing to be directed toward a similar place and/or recess of the projection of the ejector during the ejection process. In some examples, the recess defined by the ejector enables the cartridge casing to engage a similar location on the projection and/or to enable the cartridge to be ejected from the firearm and/or receiver in a repeatable manner, for example.

In some examples, the example ejector is less prone to malfunctions, is less prone to wear and/or has a longer useful life in comparison to some other example ejectors. In some examples, the example ejector is movably biased within and/or relative to the receiver using, for example, an elastic element, a spring, a supporting elastic element, etc. In some examples, the spring is a spiral spring that is coupled and/or seated on the body of the ejector to provide a resilient force to urge the ejector forward toward the muzzle of the firearm after being impacted. In some examples, if a spring is damaged and/or malfunctions, the spring may be repaired and/or replaced. In some examples, the forward motion of the ejector by the springs imparts a repeatable rotation motion onto cartridge casings being ejected from the firearm.

In some examples, the ejector includes recesses and/or spring seats that receive and/or guide the springs. In some examples, the recesses and/or spring seats reduce the likelihood that the ejector and/or the springs malfunction. In some examples, the guide channels in which the springs are disposed substantially prevent the springs from bending. In some examples, the recesses and/or spring seats are blind holes that receive the springs. In some examples, one or more guide channels are provided into which corresponding springs are disposed.

In some examples, guide sleeves and/or channels are used to receive the springs. In some examples, the guide sleeves substantially reduce the likelihood that the springs bend and/or malfunction during operation, for example. In some examples, the diameter and/or size of the guide sleeves are complementary to the size and/or diameter of the springs. In some examples, ends of the guide sleeves distal to the ejector are closed and/or the guide sleeves may be formed as a blind hole. In some examples, the positioning and/or sizing of the fasteners, the surfaces against which the guide sleeves engage, the springs, etc., enable the springs to be placed in a pretensioned state within the receiver.

In some examples, the fasteners used to secure the plate to the receiver and/or to secure the ejector within the receiver are bolts, screws, etc. In some examples, the springs urge the ejector forward toward the muzzle end to a resting position in a reliable manner such that the ejector in the resting position is in a similar and/or the same position. With the ejector in the similar and/or the same position, a cartridge casing can reliably strike and/or engage the ejector in an expectable and/or repeatable manner and/or the engagement force of the cartridge casing can be absorbed by the springs and/or cartridge casing can be urged to rotate by the ejector in an expectable and/or repeatable manner. In some examples, the ejector includes surfaces and/or guides and/or notches that interact with the fasteners to guide the longitudinal movement of the ejectors and/or to enable the ejector to be positioned in expectable and/or repeatable positions in, for example, the resting position, the impacted position and/or between the resting position and the impacted position.

In some examples, the ejector is has a U-shape with two legs that are interconnected by a connecting part and/or bridge. In some examples, the legs extend along and/or relative to the longitudinal axis of the firearm and/or toward the stock of the firearm. In some examples, the bridge extends along and/or relative to a transverse axis of the firearm. In some examples, the projection of the ejector extends into a guide channel of the receiver to enable engagement with a cartridge casing during the recoil process. In some examples, the ejector is symmetric relative to a longitudinal axis of the firearm to enable, for example, forces to be distributed to the receiver and/or to enable the cartridge casing to reliably engage the ejector in a repeatable manner. In some examples, the examples disclosed herein and/or the design of the ejector reduces the likelihood of failures and/or malfunctioning.

In some examples, the legs of the ejector define apertures, recesses and/or spring seats to secure ends of the respective springs relative to the ejector. In some examples, in the impacted position, the legs of the ejector are spaced from and, thus, do not directly engage ends of the guide springs. However, in other examples, the legs of the ejector engage the guide sleeves in the impacted position if, for example, the springs malfunction and/or fail.

In some examples, the ejector includes surfaces and/or guide surfaces that interact with the receiver to guide the movement of the ejector. In some examples, the guide surfaces of the ejector are formed on one or more surfaces (e.g., a top surface, one or more of the side surfaces, a bottom surface) of the ejector and/or the legs of the ejector. In some examples, the guide surfaces of the ejector are relatively small to reduce the frictional engagement between the receiver and the ejector. In some examples, the ejector includes a recess(es) adjacent at least one of the guide surfaces. In some examples, the recesses enable particulate (e.g., dirt, sand, earth, rocks, etc.) to be urged into the recesses during the movement of the ejector to substantially reduce the likelihood that the ejector malfunctions, for example. In some examples, two springs are used to bias the ejector where first ends of the springs are received in spring seats and/or spring guides and second ends of the springs engage respective closed ends of guide sleeves and/or the receiver.

In some examples, the legs of the ejector are relatively parallel to one another and receive springs at the ends to substantially enable the smooth transitioning of the ejector and/or substantially prevent malfunctioning from occurring.

In some examples, the guide and impact recess is tilted downward and/or includes a guide channel that complements and/or at least partially complements the base of the cartridge casing to, for example, guide the cartridge into a defined ejection position. In some examples, the projection of the ejector includes a substantially vertical guide and impact surface. In some examples, when impacting the projection, the base of the cartridge casing engages the rear, vertical impact and guide surface and another portion of the cartridge casing engages and/or impacts the horizontal impact and guide surface. In some examples, the receiver defines a recess and/or channel to accommodate and/or receive the ejector and/or enable longitudinal movement of the ejector within the receiver, for example. In some examples, a bracket(s) and/or another structure is positioned and/or coupled to the receiver to enable longitudinal movement of the ejector within the receiver. In some examples, the receiver and/or the alternative structure and/or bracket enables the longitudinal movement of the ejector within the receiver and/or substantially prevents and/or deters the ejector from tilting and/or canting within the receiver. In some examples, the receiver and/or the alternative structure and/or brackets include guide surfaces that engage and/or correspond to the guide surfaces of the receiver.

In some examples, the receiver is a single-piece receiver. In some examples, the receiver is a multi-piece receiver (e.g., two shells that are coupled along a longitudinal axis of the firearm). In some examples, the ejector is coupled to and/or disposed within the receiver at a position to enable the projection of the ejector to be engaged by the cartridge base during the ejection process. In some examples, the receiver may include one or more components described in DE 10 2010 009 488 B3. DE 10 2010 009 488 B3 is incorporated herein by reference in its entirety.

In some examples, the receiver includes a first recess that guides and/or accommodates a guide element and/or the ejector to enable the ejector to be flush with and/or complementary to the guide element. In some examples, a second recess is provided to accommodate a guide element and/or may include a blind bore defined by the receiver and/or a structure coupled to the receiver. In some examples, the interaction between the ejector and the receiver substantially ensures smooth longitudinal movement of the ejector within and/or relative to the receiver. In some examples, an interaction between the springs, the ejector and the receiver substantially buffers the impact with a cartridge casing during the ejection process and/or the movement of the ejector is at least partially guided based on the interaction between the ejector, the fasteners, the receiver, the springs, etc. In some examples, the receiver includes recesses and/or channels (e.g., symmetric and/or opposing recesses and/or channels) that accommodate corresponding guide elements (e.g., portions of the ejector, the spring sleeves, the springs, etc.). In some examples, the symmetric positioning of the recesses and/or channels substantially deter and/or prevent the ejector from tipping and/or canting during longitudinal movement of the ejector.

In some examples, a stabilizing element and/or plate is provided and/or coupled to the receiver in a direction transverse to the firing direction. In some examples, the stabilizing element is a bridge and/or plate that is coupled the receiver at, for example, a central position on an upper surface of the receiver. In some examples, the plate provides an upper surface that forms a portion of the recess and/or channel in which the ejector is disposed. In some examples, the plate increases the stability of the receiver shells and/or deters and/or substantially prevents the receiver shells from tilting, etc. In some examples, the receiver shells are coupled by the plate and/or other structures with a weld, glue, fasteners, etc.

In some examples, the plate is coupled to the receiver using one or more fasteners. In some examples, the fasteners act as a forward most stop for the ejector and/or guide the movement of the ejector within the receiver and/or substantially ensures that the springs and/or the ejector are pretensioned. In some examples, the fasteners are screws, bolts, etc. In some examples, the fasteners are disposed at a substantially right angle relative to the receiver. In some examples, apertures of the receiver that receiver the fasteners enable alignment of the plate, the ejector, etc., relative to the receiver.

In some examples, firearms and/or receiver can be retrofitted with the example ejectors disclosed herein. The examples disclosed herein enable cartridges to be reliably ejected from a firearm while reducing the wear and/or increasing the useful life of such firearms, components of such firearms and/or ejectors on which recoil forces are imparted.

An example ejector (1) for a firearm includes an ejector main body (5) having an ejector element (46) disposed thereon, such that the ejector element (46), after mounting the ejector (1) on the receiver (3) of the firearm extends into the movement path of a forward and backward running breechblock (71) that is guided in the receiver (3) such that it can move longitudinally, forms a counter bearing for the casing base (61) of a cartridge casing (59) extracted by the returning breechblock (71) from the cartridge chamber, and ejects and/or discards the cartridge casing (59) from the receiver (3) after interacting with the casing base (61), wherein the ejector (1) includes additional means (7*a, b*, 9*a, b*, 11*a, b*, 13*a, b*), by means of which the ejector element (46) is flexibly supported in relation to the receiver (3) such that it returns slightly in a straight line together with the casing base (61) as a result of an interaction with said casing base, until the ejector is slowed to a standstill, and ejects/discards the cartridge casing (59) thereby characterized in that the ejector element (46) includes a basically cuboid guide and impact recess (47) on its end protruding into the movement path (3) of the breechblock, which extends backward, toward the returning cartridge casing (69), and as a result, has at least one guide and impact surface (51) running in this direction, for the cartridge casing (59) that is to be ejected.

In some examples, the means (7*a, b*, 9*a, b*, 11*a, b*, 13*a, b*) of which for a flexible support of the ejector element (46) include at least one elastic element (7*a, b*) that can be secured in or on the receiver (3). In some examples, the elastic element (7*a, b*) of which is a spring, in particular a spiral spring. In some examples, the means (7*a, b*, 9*a, b*, 11*a, b*, 13*a, b*) of which for the flexible support of the ejector element (46) includes at least one accommodating recess (11*a, b*) in the ejector main body (5) for guiding and accommodating the at least one elastic element (7*a, b*). In some examples, the means (7*a, b*, 9*a, b*, 11*a, b*, 13*a, b*) of which include at least one accommodating and guide element (9*a, b*) that can be secured on the receiver (3) for a supplementary accommodation and guidance of the at least one elastic element (7*a, b*).

In some examples, the ejector including at least one securing element (19*a, b*), which retains and secures the elastic element (7*a, b*) in a pretensioned state. In some examples, on the ejector main body (5) of which, at least one contact and/or guide surface (53*a, b*) is provided, for the contact and/or guidance thereof on the at least one securing element (19*a, b*). In some examples, the ejector main body (5) of which is designed in the manner of a U, and which can be disposed in or on the receiver (3), transverse to the direction of firing, with a connecting part (44) that connects its two U-legs (45*a, b*) in the manner of a bridge, and which extends thereby over the width of the receiver, while its two U-legs (45*a, b*) extend toward the rear in the longitudinal direction of the receiver.

In some examples, the U-legs (45*a, b*) of which each include guide surfaces (55*a, b*) for guiding the ejector main body (5) in or on the receiver (3). In some examples, the ejector having at least one recess (57*a, b*) in each of the guide surfaces (55*a, b*). In some examples, the ejector having two elastic elements (7*a, b*) disposed symmetrically to one another, each having associated accommodating and guide recesses (11*a, b*) in the two U-legs (45*a, b*) of the ejector main body (5) and having accommodating and guide elements (9*a, b*) that can be secured on the receiver (3).

In some examples, the at least one guide and impact surface (51) of which runs toward the rear and is slanted downward thereby, and/or has a guide channel that is at least nearly complementary to the casing base (61). In some examples, the guide and impact recess (47) of which has at least one vertical guide and impact surface (49) for the casing base (61) of the cartridge casing (59) that is to be ejected. A receiver (3) including a breechblock guided in the receiver (3) such that it can move longitudinally, and an ejector (1).

In some examples, a receiver includes at least one recess (27*a, b*) that is complementary to the ejector main body (5), for the accommodation and longitudinal movement guidance thereof. In some examples, the receiver includes at least one recess (63*a, b*) for accommodating and guiding the at least one accommodation and guide element (9*a, b*), wherein the recess (63*a, b*) is flush with the recess (27*a, b*) for accommodating the ejector main body (5), and is designed such that it is complementary to the accommodation and guide element (9*a, b*).

In some examples, the receiver includes at least two recesses (27*a, b*) that are formed symmetrical to one another in the receiver (3), for accommodating, in each case, one of two accommodating and guide elements (9*a, b*). In some examples the receiver includes a stabilizing element (15) is provided, for stabilizing the receiver (1), disposed transverse to the direction of firing.

In some examples, the stabilizing element (15) of which is secured and/or is aligned via at least one securing element (19*a, b*) on the receiver (1), and the securing element (19*a, b*) also simultaneously retains and secures the ejector main body (5) in the receiver (3) in a tensioned manner. In some examples, a firearm having an ejector (1) includes an example ejector and/or a receiver (3) includes an example ejector.

In some examples, an ejector (1) for a firearm includes an ejector main body (5) having an ejector element (46) disposed thereon such that the ejector element (46), after mounting the ejector (1) on the receiver (3) of the firearm, protrudes into the movement path of a forward and backward running breechblock that is guided in the receiver (3) such that it can move longitudinally, forms a counter bearing for the casing base (61) of a cartridge casing (59) extracted by the returning breechblock (71) from the cartridge chamber, and ejects and/or discards the cartridge casing (59) from the receiver (3) after interacting with the casing base (61), wherein the ejector (1) includes additional means (7*a, b*, 9*a, b*, 11*a, b*, 13*a, b*), by means of which the ejector element (46) is flexibly supported in relation to the receiver (3) such that is returns slightly in a straight line together with the casing base (61) as a result of an interaction with said casing base, until the ejector is slowed to a standstill, and ejects/discards the cartridge casing (59) thereby. The invention furthermore relates to a receiver (3) including a breechblock guided in the receiver (3) such that it can move longitudinally, and an ejector (1). Lastly, the invention relates to a firearm having such an ejector and/or such a receiver (3).

An ejector for a firearm includes a body including a projection extending therefrom, the ejector to be movably coupled to a receiver of the firearm to enable the projection including an engagement surface to be disposed in a movement path of a breechblock, the engagement surface to be engaged by a cartridge casing during a recoil process to enable the cartridge casing to be ejected from the firearm; and a spring to bias the body relative to the receiver, the body to be movable relative to a longitudinal axis of the receiver upon impact with the cartridge, the spring to absorb some force imparted to the body from the impact.

In some examples, the spring absorbing some force imparted to the body from the impact means that a portion of the impact force imparted by the cartridge casing is absorbed by the spring. In some examples, the body defines a spring seat to receive an end of the spring, the spring to be disposed within the receiver. In some examples, the spring is a spiral spring. In some examples, the ejector includes a guide sleeve into which the spring is to be disposed. In some examples, the spring is a first spring, further including a second spring, the first spring to be received in a first spring seat of the body on a first lateral side of the body, the second spring to be received in a second spring seat of the body on a second side of the body.

In some examples, the ejector includes a stop to be engaged by the body in a resting position, the spring to bias the body into engagement with the stop. In some examples, the ejector includes a plate to be coupled to the receiver to at least partially form a channel in which the ejector is to be disposed, the plate to be coupled to the receiver using a fastener, the spring to urge the body into engagement with the fastener. In some examples, the body defines a first lateral notch and a second lateral notch, surfaces defining the first and second lateral notches to be engaged by guides to at least partially guide the movement of the body relative to the receiver. In some examples, the guides include fasteners. In some examples, the ejector includes plate to be coupled to the receiver using the fasteners, the plate to at least partially form a channel in which the ejector is to be disposed.

In some examples, the body includes a first portion, a second portion, and a third portion, the second portion to be coupled to and extend between the first and third portions, the first and third portions to extend toward a rear of the receiver. In some examples, the first and third portions include guide surfaces to at least partially guide the movement of the body relative to the receiver. In some examples, the first and third portions define recesses, the recesses to encourage debris to be received therein as the body moves relative to the longitudinal axis. In some examples, the engagement surface includes a portion that is non-parallel relative to a longitudinal axis of the receiver. In some examples, the ejection surface includes a profile that is at least partially complementary to a portion of the cartridge casing.

An example apparatus includes a firearm including a receiver; an ejector to be movably coupled to the receiver; and a spring to bias the ejector toward a muzzle of the firearm, the ejector to be movable relative to a longitudinal axis of the firearm upon impact with a cartridge casing during a recoil process of the firearm, the spring to at least partially absorb some of the impact. In some examples, the receiver defines a channel in which the ejector is disposed, the spring to bias the ejector within the slot into engagement with a stop. In some examples, the ejector is symmetric about a longitudinal axis of the ejector. In some examples, the spring is a first spring, further including a second spring, the first spring to be received in a first spring seat of the body on a first lateral side of the body, the second spring to be received in a second spring seat of the body on a second side of the body. In some examples, the apparatus includes a first stop and a second stop, the ejector be biased into engagement with the first and second stops, an interaction between the ejector and the first and second stops to at least partially guide the movement of the ejector.

An example apparatus includes a receiver; an ejector to be movably coupled to the receiver; and a spring to bias the ejector toward a stop, the ejector to be movable relative to a longitudinal axis of the receiver upon impact with a cartridge casing during a recoil process, the spring to at least partially absorb some of the impact.

An example apparatus includes a receiver; and an ejector including means for absorbing an impact with a cartridge casing. In some examples, the means for absorbing the impact with the cartridge casing includes a spring, the spring to urge the ejector into engagement with a stop, the ejector movably disposed within a channel defined by the receiver.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An ejector for a firearm, comprising:

a body including a projection extending therefrom, the ejector to be movably coupled to a receiver of the firearm to enable the projection including an engagement surface to be disposed in a movement path of a breechblock, the engagement surface to be engaged by a cartridge casing during a recoil process to enable the cartridge casing to be ejected from the firearm;

a spring to bias the body relative to the receiver, the body to be movable relative to a longitudinal axis of the receiver upon impact with the cartridge; and a plate to be coupled to the receiver to at least partially form a channel in which the ejector is to be disposed, the plate to be coupled to the receiver using a fastener, the spring to urge the body into engagement with the fastener.

2. The ejector of claim 1, wherein the body defines a first lateral notch and a second lateral notch, surfaces defining the first and second lateral notches to be engaged by guides to at least partially guide the movement of the body relative to the receiver.

3. The ejector of claim 2, wherein the guides include fasteners.

4. The ejector of claim 1, wherein the body includes a first portion, a second portion, and a third portion, the second portion to be coupled to and extend between the first and third portions, the first and third portions to extend toward a rear of the receiver.

5. The ejector of claim 4, wherein the first and third portions include guide surfaces to at least partially guide the movement of the body relative to the receiver.

6. An ejector for a firearm, comprising:

a body including a projection extending therefrom, the ejector to be movably coupled to a receiver of the firearm to enable the projection including an engagement surface to be disposed in a movement path of a breechblock, the engagement surface to be engaged by a cartridge casing during a recoil process to enable the cartridge casing to be ejected from the firearm;

a spring to bias the body relative to the receiver, the body to be movable relative to a longitudinal axis of the receiver upon impact with the cartridge, wherein the body defines a first lateral notch and a second lateral notch, surfaces defining the first and second lateral notches to be engaged by guides, the guides include fasteners, the guides to at least partially guide the movement of the body relative to the receiver; and a plate to be coupled to the receiver using the fasteners, the plate to at least partially form a channel in which the ejector is to be disposed.

7. An ejector for a firearm, comprising:

a body including a projection extending therefrom, the ejector to be movably coupled to a receiver of the firearm to enable the projection including an engagement surface to be disposed in a movement path of a breechblock, the engagement surface to be engaged by a cartridge casing during a recoil process to enable the cartridge casing to be ejected from the firearm, wherein the body includes a first portion, a second portion, and a third portion, the second portion to be coupled to and extend between the first and third portions, the first and third portions to extend toward a rear of the receiver, the first and third portions include guide surfaces to at least partially guide the movement of the body relative to the receiver, the first and third portions define recesses, the recesses to encourage debris to be received therein as the body moves relative to a longitudinal axis of the receiver; and a spring to bias the body relative to the receiver, the body to be movable relative to the longitudinal axis of the receiver upon impact with the cartridge.

8. The ejector of claim 7, wherein the body defines a spring seat to receive an end of the spring, the spring to be disposed within the receiver.

9. The ejector of claim 7, wherein the spring is a spiral spring.

10. The ejector of claim 7, further including a guide sleeve into which the spring is to be disposed.

11. The ejector of claim 7, wherein the spring is a first spring, further including a second spring, the first spring to be received in a first spring seat of the body on a first lateral side of the body, the second spring to be received in a second spring seat of the body on a second side of the body.

12. The ejector of claim 7, further including a stop to be engaged by the body in a resting position, the spring to bias the body into engagement with the stop.

13. The ejector of claim 7, wherein the engagement surface includes a portion that is non-parallel relative to a longitudinal axis of the receiver.

14. The ejector of claim 7, wherein the engagement surface includes a profile that is at least partially complementary to a portion of the cartridge casing.

15. An apparatus, including:

a firearm including a receiver;

an ejector having a body including a projection extending therefrom, the ejector to be movably coupled to the receiver of the firearm to enable the projection including an engagement surface to be disposed in a movement path of a breechblock, the engagement surface to be engaged by a cartridge casing during a recoil process to enable the cartridge casing to be ejected from the firearm, wherein the body includes a first portion, a second portion, and a third portion, the second portion to be coupled to and extend between the first and third portions, the first and third portions to extend toward a rear of the receiver, the first and third portions including guide surfaces to at least partially guide the movement of the body relative to the receiver, the first and third portions define recesses, the recesses to encourage debris to be received therein as the ejector moves relative to a longitudinal axis of the firearm; and a spring to bias the ejector toward a muzzle of the firearm, the ejector to be movable relative to the longitudinal axis of the firearm upon impact with the cartridge casing during the recoil process of the firearm.

16. The apparatus of claim 15, wherein the receiver defines a channel in which the ejector is disposed, the spring to bias the ejector within the channel into engagement with a stop.

17. The apparatus of claim 15, wherein the ejector is symmetric about a longitudinal axis of the ejector.

18. The apparatus of claim 15, wherein the spring is a first spring, further including a second spring, the first spring to be received in a first spring seat of the body on a first lateral side of the body, the second spring to be received in a second spring seat of the body on a second side of the body.

19. The apparatus of claim 18, further including a first stop and a second stop, the ejector to be biased into engagement with the first and second stops, an interaction between the ejector and the first and second stops to at least partially guide the movement of the ejector.

20. An apparatus, including:

a receiver;

an ejector having a body including a projection extending therefrom, the ejector to be movably coupled to the receiver of a firearm to enable the projection including an engagement surface to be disposed in a movement path of a breechblock, the engagement surface to be engaged by a cartridge casing during a recoil process to enable the cartridge casing to be ejected from the firearm, wherein the body includes a first portion, a second portion, and a third portion, the second portion to be coupled to and extend between the first and third portions, the first and third portions to extend toward a rear of the receiver, the first and third portions including guide surfaces to at least partially guide the movement of the body relative to the receiver, the first and third portions define recesses, the recesses to encourage debris to be received therein as the ejector moves relative to a longitudinal axis of the receiver; and a spring to bias the ejector toward a stop, the ejector to be movable relative to the longitudinal axis of the receiver upon impact with the cartridge casing during the recoil process.

* * * * *